US008485099B2

(12) United States Patent
Skidmore et al.

(10) Patent No.: US 8,485,099 B2
(45) Date of Patent: Jul. 16, 2013

(54) MINE DEFEAT SYSTEM AND PYROTECHNIC DART FOR SAME

(75) Inventors: Mark A. Skidmore, Mesa, AZ (US); Andrew R. Davis, Phoenix, AZ (US); Thomas V. Palen, Mesa, AZ (US); Christian W. Salafia, Orlando, FL (US); Thomas M. Deppert, Gilbert, AZ (US); Gregory D. Knowlton, Gilbert, AZ (US)

(73) Assignee: Nammo Talley, Inc., Mesa, AZ (US)

( * ) Notice: Subject to any disclaimer, the term of this patent is extended or adjusted under 35 U.S.C. 154(b) by 589 days.

(21) Appl. No.: 12/474,366

(22) Filed: May 29, 2009

(65) Prior Publication Data

US 2012/0186479 A1 Jul. 26, 2012

Related U.S. Application Data

(60) Provisional application No. 61/079,618, filed on Jul. 10, 2008.

(51) Int. Cl.

| | |
|---|---|
| ***F42B 12/44*** | (2006.01) |
| ***F42B 12/58*** | (2006.01) |
| ***F42C 7/00*** | (2006.01) |

(52) U.S. Cl.

USPC ..... 102/364; 102/393; 102/402; 102/489; 89/1.13

(58) Field of Classification Search

USPC ..... 102/364, 402, 489, 499, 519, 365, 102/396, 403, 393; 89/1.13

See application file for complete search history.

(56) References Cited

U.S. PATENT DOCUMENTS

| | | | | |
|---|---|---|---|---|
| 1,181,278 | A | | 5/1916 | Wiley |
| 3,254,996 | A | * | 6/1966 | MacDonald ..... 419/6 |
| 3,888,179 | A | * | 6/1975 | Nord et al. ..... 102/364 |
| 3,992,996 | A | * | 11/1976 | Strandli ..... 102/364 |
| 4,002,121 | A | * | 1/1977 | Prochnow et al. ..... 102/364 |
| 4,015,355 | A | * | 4/1977 | Schiessl et al. ..... 42/105 |
| 4,112,846 | A | * | 9/1978 | Gilbert et al. ..... 102/364 |
| 4,331,080 | A | | 5/1982 | West et al. |
| 4,648,324 | A | * | 3/1987 | McDermott ..... 102/518 |
| 4,671,181 | A | * | 6/1987 | Romer et al. ..... 102/518 |
| 4,770,102 | A | | 9/1988 | Bisping et al. |
| 4,777,882 | A | | 10/1988 | Dieval |
| 4,922,826 | A | * | 5/1990 | Busch et al. ..... 102/489 |
| 4,978,400 | A | | 12/1990 | Juneau, Jr. et al. |
| 6,105,505 | A | * | 8/2000 | Jones ..... 102/364 |
| 6,354,222 | B1 | | 3/2002 | Becker et al. |
| 6,401,591 | B1 | | 6/2002 | Ross et al. |
| 6,402,864 | B1 | | 6/2002 | Gill et al. |
| 6,409,854 | B1 | | 6/2002 | Gill et al. |
| 6,439,127 | B1 | | 8/2002 | Cherry |
| 6,485,586 | B1 | | 11/2002 | Gill et al. |
| 6,540,175 | B1 | | 4/2003 | Mayersak et al. |
| 6,546,838 | B2 | | 4/2003 | Zavitsanos et al. |
| 6,679,176 | B1 | | 1/2004 | Zavitsanos et al. |
| 6,691,622 | B2 | | 2/2004 | Zavitsanos et al. |
| 6,748,842 | B1 | | 6/2004 | Guirguis |
| 6,945,175 | B1 | | 9/2005 | Gotzmer et al. |
| 7,004,073 | B2 | | 2/2006 | Michel |

(Continued)

*Primary Examiner* — James Bergin

(74) *Attorney, Agent, or Firm* — Kenyon & Kenyon, LLP

(57) ABSTRACT

The invention provides a method and a system for defeating a target containing a flammable or explosive fill and an incendiary penetrating projectile for use in the method and the system. The incendiary penetrating projectile contains a non-detonating incendiary composition that is ignited prior to penetrating a target.

20 Claims, 5 Drawing Sheets

U.S. PATENT DOCUMENTS

| | | | |
|---|---|---|---|
| 7,261,039 | B1 | 8/2007 | Bittle et al. |
| 7,278,356 | B1 | 10/2007 | Geisler et al. |
| 2003/0127013 | A1 | 7/2003 | Zavitsanos et al. |
| 2005/0199323 | A1 | 9/2005 | Nielson et al. |
| 2008/0028922 | A1 | 2/2008 | Wilson et al. |
| 2008/0035007 | A1 | 2/2008 | Nielson |

* cited by examiner

10

MINE DEFEAT SYSTEM AND PYROTECHNIC DART FOR SAME

RELATED APPLICATION

This application claims benefit of U.S. Provisional Patent Application No. 61/079,618, filed Jul. 10, 2008, the contents of which are incorporated herein in their entirety by reference.

FIELD OF THE INVENTION

The invention is directed to methods, projectiles, and systems for the defeat or destruction of targets containing combustible and/or explosive materials. In particular, the invention is directed to mine defeat systems and methods that rely on the penetration and subsequent deflagration or detonation of the energetic fill of a mine, such that the mine is destroyed or rendered inoperable, and to non-detonating pyrotechnic darts or incendiary penetrating projectiles for use in such systems.

BACKGROUND OF THE INVENTION

Methods using explosive charges and hypergolic liquids to clear minefields are known. One such system uses a rocket to deploy a line charge that, upon detonation, detonates buried mines. The system is mounted on a trailer, and positioned next to a mine field to be cleared. When the system is triggered, a rocket deploys a flexible cord-like charge of explosive, i.e., the line charge, over the minefield. Detonation of the cord on or near the surface of the minefield substantially clears safe lanes for movement. However, a line charge requires placement of the system in close proximity to the minefield, and is not capable of clearing mines submerged underwater or in a surf zone.

Fuel-air explosives have also been used to detonate buried mines. Multiple rocket salvos that disperse clouds of fuel in the form of a vapor or aerosol that mixes with air are fired from a ground based launch platform above a mine field. Detonation of the fuel-air mixture creates a large pressure pulse to initiate mines under the blast. Timing of the fuel-air cloud initiation is complex, as the fuel-air mixture must be within flammability limits. In addition, the method cannot detonate mines submerged underwater or in a surf zone, and again requires the launch system to be in close proximity to mine field.

Mine field clearing systems that require close proximity to the mine field and cannot clear underwater mines are typically only capable of clearing inland mine fields using troops that are already in place on the ground. Therefore, such systems cannot be used to clear surf zones and beach areas to support amphibious landings.

As a result, high explosive munitions have been used to clear mines for amphibious landings. An area known to contain mines is repeatedly bombarded with high explosive weapons in an attempt to damage, detonate, or otherwise displace the buried mines. The method is highly ineffective, requiring multiple salvos. In addition, such a bombardment is typically not capable of clearing mines submerged underwater or in a surf zone. The method may also damage the landing area, rendering the beach unusable for amphibious operations. The use of high explosive weapons can also result in the additional problem of unexploded ordnance (UXO) when one or more of the weapons fail to detonate.

High velocity projectiles, also known as penetrators, filled with an explosive charge or hypergolic liquid, have recently been developed to defeat mines prior to an amphibious landing. The projectiles are reportedly capable of defeating at least a portion of buried and underwater mines deployed in beaches and surf zones. In addition, the penetrators can be deployed from over the horizon with guided or gun launched munitions to clear landing areas prior to troops being put on the ground.

An explosive filled, high velocity projectile or penetrator is intended to penetrate a mine and detonate after a short delay. The shock from the detonating projectile initiates the mine fill, resulting in a high order detonation or structural failure of the mine. This requires precise fusing, as detonation of the penetrator must occur inside the mine to be effective. Reliable target discrimination and timing are a challenge, as the penetrating projectile is typically initiated by impact with the mine case, which may be made of a wide variety of materials, ranging from soft plastic to hard steel. Where the target is relatively thin or lightly cased, and the projectile velocity is high, the projectile may detonate after passing though the target rather than inside. This may damage the mine without detonating or disabling the device. In addition, where the fusing fails to function on impact, or the target is missed, the penetrator may not initiate, creating an unexploded ordnance issue in the target area. A penetrator containing an explosive fill must also contain a safe and arm (S&A) mechanism to allow for safe handling, transport, and storage. Safe and arm mechanisms reduce reliability, reduce the energetic payload volume of a penetrator for a given size and add significant cost to the penetrator.

A projectile filled with hypergolic liquid is intended to penetrate a mine, and fracture the explosive fill. The payload section, containing the hypergolic liquid, ruptures on impact, allowing the liquid to permeate throughout fractured explosive fill of the mine. The hypergolic liquid reacts chemically with the nitro groups of the explosive fill, generating considerable heat and flame, and, preferably, igniting the explosive fill. The extent of the fracturing of the explosive fill of the mine determines the effectiveness of the hypergolic liquid. Without exposure of a sufficient amount of surface area of the explosive fill to the hypergolic liquid, the energetic material in the mine will not ignite readily and sustain combustion.

In addition, the penetrator must reliably rupture on-target when encountering a variety of mine case materials and overburdens. Typical overburdens of many target devices include water, sand, dirt, wood, or sheet metal. These overburdens offer similar resistance as soft plastic target cases. In addition, where the mine is submerged, water may render the hypergolic liquid ineffective by diluting or washing away the hypergolic liquid before reaction with the explosive fill.

There are also many different energetic fills used in mines. A given hypergolic liquid may be quite effective against one type of energetic fill, but totally ineffective against another. Hypergolic liquids are also extremely toxic, and, thus, pose a handling and storage risk should an unintentional leak or rupture of the penetrator occur.

U.S. Pat. No. 6,401,591 reports a device for clearing mines. The device has a housing assembly with a chamber that carries a surface contact chemical reportedly capable of consuming an explosive fill within a mine. A nose assembly, attached to the housing assembly, separates from the housing assembly when the device contacts a solid mass. The nose assembly is reportedly capable of penetrating a mine housing, and contacting the mine explosive fill sufficiently to expose the fill, such that the surface contact chemical can consume the fill. A plurality of the devices reportedly can be used to conduct a mine clearance operation in a surf zone or on a beach.

As discussed above, the extent of the fracturing of the explosive fill of the mine determines the effectiveness of the surface contact chemical. Without exposure of a sufficient amount of surface area of the explosive fill, the energetic material in the mine will not ignite readily and sustain combustion. In addition, the penetrator must reliably rupture on-target when encountering a variety of mine case materials and overburdens, and, where the mine is submerged, water may render the surface contact chemical ineffective by diluting or washing away the chemical before reaction with the explosive fill.

U.S. Pat. No. 6,748,842 reports a kinetic energy driven projectile for defeating unexploded ordnance or buried land mines. The projectile has a small amount of insensitive high explosive material that is cap sensitive in one tip of the projectile, along with an initiation mechanism. Detonation of the high explosive material reportedly more fully fractures the explosive material within a mine, allowing a neutralization agent to completely react with all of the explosive material within the mine, and consume the entire fill. As discussed above, detonation of the explosive in the projectile must occur inside the mine to be effective.

U.S. Pat. No. 6,540,175 reports a system and a method for deflagrating/detonating anti-tank and anti-vehicle land mines, beach zone mines, and surf zone mines located in mine belts or individually using delayed active ignition high temperature incendiary flechettes or darts that are dispersed over a target. Each flechette or dart reportedly has a cavity generating nose geometry, active ignition system employing a firing pin approach, reactive fill, body assembly, and tailfins to allow them to penetrate the soil or water overburden of the mine or the mine directly in surface positioned mines to fracture the mine fill and ignite that fill to cause deflagration or detonation using the high temperature incendiary fill contained in the countermine dart. The delayed ignition system ignites the high temperature incendiary fill of the flechette or dart at impact with the plastic or steel-cased mine. The reaction time from the point at which the flechette or dart hits the mine to the point at which the energy is released is on the order of 50 microseconds. Thus, the reported flechette or dart requires impact with the target for ignition.

U.S. Pat. No. 7,004,073 reports a bellows, spool, and collar system for dispensing projectiles and sub-munitions in a predictable and uniform pattern. The system uses a plurality of spools, packed with projectiles, where the spools are packaged in a missile, bomb, or similar tubular device with an energetic bellows actuator between each spool. The energetic bellows actuator expands rapidly to push a spool of projectiles out of the tubular housing.

U.S. Pat. No. 6,546,838 reports a projectile for the destruction of unexploded ordnance. The projectile is a dart filled with a reactive composition of a metal, an oxidizer, and a binder. The reactive composition is carried by the delivery dart to the mine, and is then initiated.

U.S. Pat. No. 6,691,622 reports a projectile for the destruction of unexploded ordnance containing a reactive composition of a metal and an oxidizer. The reactive composition is only initiated after the projectile impacts the mine.

U.S. Pat. No. 6,354,222 reports a projectile and a method for the destruction of normally explosive targets by deflagration that can be used in existing rapid fire guns without modification. The projectile uses a tracer material, ignited when the gun is fired, to ignite an intermetallic material in the projectile. The intermetallic is ignited after the projectile leaves the gun. The projectile is designed to impact the target and distribute hot fragments throughout the high explosive material of the target, causing deflagration.

SUMMARY OF THE INVENTION

The present invention is directed to a method of defeating a target containing a flammable or explosive fill, a system for defeating a target containing a flammable or explosive fill, and an incendiary penetrating projectile or dart for use in the method and the system. The method comprises applying an acceleration pulse to a projectile containing a non-detonating incendiary composition, thereby providing an increase in velocity to the projectile, igniting the non-detonating incendiary composition during or at about termination of the acceleration pulse and before penetrating a target, penetrating a target containing a flammable or explosive fill with the projectile containing the ignited non-detonating incendiary composition, and igniting and/or detonating the flammable or explosive fill of the target with heat and/or flame from the ignited non-detonating incendiary composition. The non-detonating incendiary composition is preferably ignited with an inertial ignition system at about termination of the acceleration pulse.

Preferably, the acceleration pulse is provided by a gas generator or propellant charge. More preferably, the acceleration pulse is applied simultaneously to a plurality of projectiles containing a non-detonating incendiary composition, and the non-detonating incendiary composition is ignited in almost all of the projectiles during or at about termination of the acceleration pulse and before penetrating a target. Where ignition does not occur during or at about termination of the acceleration pulse in a particular incendiary penetrating projectile, the incendiary composition is preferably ignited upon impact of the projectile. That ignition may be upon impact with an overburden or upon impact with the target.

Preferably, at least a portion of the projectiles penetrate different targets. Preferred primary targets include, but are not limited to, mines in a minefield, in a surf zone, or under water. The plurality of projectiles are preferably directed to a target field before the acceleration pulse, and dispersed over the target field at the end of or after the acceleration pulse. Incendiary penetrating projectiles that penetrate a target preferably remain within the target after penetrating the target.

An incendiary penetrating projectile of the invention preferably comprises a nose portion, sufficiently hard to penetrate an intended target, a container or body portion, disposed behind and in functional connection with the nose portion, and containing a non-detonating incendiary composition, and an inertial ignition system configured to ignite the non-detonating incendiary composition during or at about termination of an acceleration in the direction of the nose portion. Preferred non-detonating incendiary compositions include, but are not limited to composite propellants, thermites, thermates, and intermetallics. More preferably, the non-detonating incendiary composition is one of Ti/B, Ti/B/Viton A, B/Zr, Al/B, C/Ti, Mg/S, Al/CuO, Zr/CuO, Mg/CuO, Ti/CuO, B/CuO, $Al/Fe_2O_3$, $Ti/Fe_2O_3$, $Mg/Fe_2O_3$, $Zr/Fe_2O_3$, $Zr/MnO_2$, $Mg/Al/KClO_4$, $Si/Zr/Fe_2O_3/KClO_4/NaSiO_4$, $Si/Zr/Fe_2O_3/KClO_4$/Viton A, $Ti/B/BaCrO_4$, $NH_4ClO_4$/Al/hydroxyl-terminated polybutadiene, $NH_4ClO_4$/hydroxyl-terminated polybutadiene, $NH_4NO_3$/epoxy, $NH_4ClO_4$/Al/polysulfide, $NH_4ClO_4$/polysulfide, $NH_4ClO_4$/Al/polyvinyl chloride, $NH_4ClO_4$/polyvinyl chloride, $NH_4ClO_4$/Al/carboxy-terminated polybutadiene, $NH_4ClO_4$/carboxy-terminated polybutadiene, $NH_4NO_3$/isoprene rubber, and $NH_4NO_3$/cellulose acetate. Thermite and intermetallic compositions are preferably substantially stoichiometric. Thermate compositions are preferably within 10 percent of stoichiometric.

The body of the incendiary penetrating projectile may also be a reactive component of the incendiary composition. Gas is produced upon ignition of certain non-detonating incendiary compositions useful in the invention, such as composite propellants. Alternatively, substantially no gas is produced upon ignition of the non-detonating incendiary composition, such as where the non-detonating incendiary composition is a thermite or an intermetallic composition.

The inertial ignition system preferably comprises a compressible first component, such as a spring or other compressible material that compresses upon acceleration in the direction of the nose portion, and expands to initiate an igniter at about termination of the acceleration pulse. The igniter preferably comprises a primer and firing pin, where the firing pin and primer are forced together by expansion of the inertial ignition system. The inertial ignition system of the incendiary projectile can further comprise a second compressible component, again, such as a spring or other compressible material that prevents initiation of the igniter when the projectile is dropped onto the nose portion from a height of about 3 meters or less.

The system for the destruction and/or disablement of targets containing explosive or energetic fills of the invention comprises a plurality of the incendiary penetrating projectile of the invention, a shell in which the incendiary projectiles are disposed, a propulsion device for providing an acceleration pulse to the shell and the projectiles therein, and a release mechanism for releasing and dispersing the projectiles.

DETAILED DESCRIPTION OF THE PREFERRED EMBODIMENTS

Figure 1:
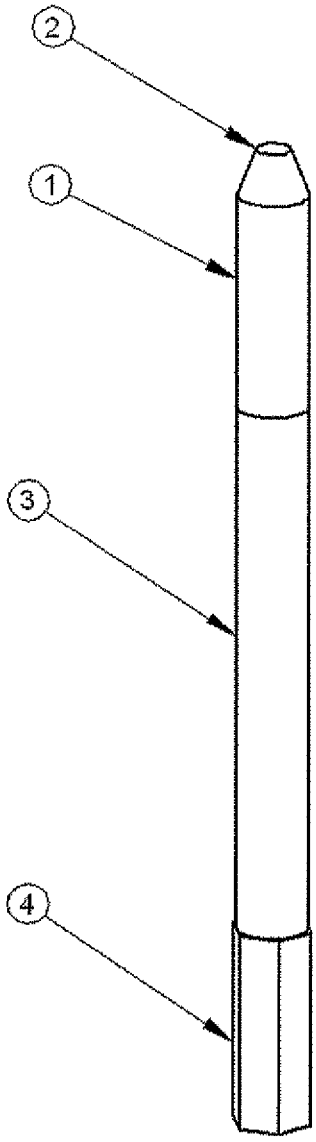
FIG. 1 is a perspective illustration of an incendiary penetrating projectile of the invention.

The invention is directed to an incendiary penetrating projectile, also referred to as a pyrotechnic dart, to a method of defeating a target containing a flammable or explosive material with one or more incendiary penetrating projectiles of the invention, and to systems comprising the incendiary penetrating projectile of the invention. An incendiary penetrating projectile of the invention is capable of igniting combustible materials or energetic fills of target devices, such as land or sea mines, other munitions and ordnance, and other containers of combustible materials. An incendiary penetrating projectile of the invention ignites the combustible material by generating sufficient heat through chemical reaction of an energetic payload carried in the body of the projectile.

The projectile preferably comprises a hard dense nose that provides overburden and target penetration, and allows the body, containing the energetic fill, to enter the device. That is, the nose preferably has a hardness and a shape that allows the projectile to pass through an overburden and penetrate a mine. For example, a projectile of the invention will typically be able to penetrate a mine after passing through 12 feet of water.

As used herein, the term "overburden" refers to water, soil, sand, or other material covering a mine, unexploded ordnance, or other target comprising an energetic fill. Preferably, the nose of the projectile is flat or blunt to improve penetration of overburden. More preferably, the nose has a flat portion that is substantially perpendicular to the direction of travel of the projectile. Preferably, the flat portion of the nose has a diameter or width of about 50 percent of the diameter or width of the projectile. Such a flat nose provides cavitation in soil, sand, or water, allowing the projectile to penetrate the overburden.

The projectile fill is preferably a non-detonating incendiary composition, and is selected to generate a considerable amount of heat to initiate combustion of the energetic fill of the target device. A high energy density fill delivers a maximum amount of heat to initiate and sustain combustion of the target fill. The energetic fill of the incendiary penetrating projectile may comprise, but is not limited to, non-detonating incendiary compositions, such as composite propellants, thermites, thermates, intermetallics, or other combustible solids. Thermite and intermetallic compositions are preferably substantially stoichiometric. Thermate compositions are preferably within 10 percent of stoichiometric. Preferred non-detonating incendiary compositions include, but are not limited to Ti/B, Ti/B/Viton A, B/Zr, Al/B, C/Ti, Mg/S, Al/CuO, Zr/CuO, Mg/CuO, Ti/CuO, B/CuO, Al/$Fe_2O_3$, Ti/$Fe_2O_3$, Mg/$Fe_2O_3$, Zr/$Fe_2O_3$, Zr/$MnO_2$, Mg/Al/$KClO_4$, Si/Zr/$Fe_2O_3$/$KClO_4$/$NaSiO_4$, Si/Zr/$Fe_2O_3$/$KClO_4$/Viton A, Ti/B/$BaCrO_4$, $NH_4ClO_4$/Al/hydroxyl-terminated polybutadiene, $NH_4ClO_4$/hydroxyl-terminated polybutadiene, $NH_4NO_3$/epoxy, $NH_4ClO_4$/Al/polysulfide, $NH_4ClO_4$/polysulfide, $NH_4ClO_4$/Al/polyvinyl chloride, $NH_4ClO_4$/polyvinyl chloride, $NH_4ClO_4$/Al/carboxy-terminated polybutadiene, $NH_4ClO_4$/carboxy-terminated polybutadiene, $NH_4NO_3$/isoprene rubber, and $NH_4NO_3$/cellulose acetate. The fill may be contained within the body of the penetrating projectile or comprise the entire incendiary penetrating projectile body.

Preferably, after penetrating a target, the incendiary penetrating projectile remains within the target. However, stopping the penetrating projectile within the body of a target is not always required with the invention. The heat and/or flame produced by the incendiary penetrating projectile body can be sufficient to ignite many target fills as the projectile passes through the fill of the target, or comes to rest beneath the target.

Ignition of the incendiary penetrating projectile preferably occurs before penetration of the target. Ignition of the non-detonating incendiary fill of the incendiary penetrating projectile is preferably initiated by an acceleration pulse of the delivery system used to deploy the incendiary penetrating projectile. That ensures that all the deployed incendiary penetrating projectiles receive the same ignition stimulus, and do not rely on impact conditions for ignition. Preferably, the acceleration pulse occurs at or shortly after the incendiary penetrating projectile is dispensed or released from the delivery system. Preferably, the incendiary penetrating projectile is dispensed from the delivery system less than about 1 second before target impact. The duration of the acceleration pulse is preferably from about 20 to about 80 ms. As will be recognized by those skilled in the art, impact conditions can vary significantly, depending upon the target type and overburden. An unknown or variable impact condition can reduce reliability of an incendiary or detonable penetrating projectile, where initiation requires impact of the projectile. Initiation of the non-detonating incendiary fill of the projectile by the acceleration pulse can occur at about the start of or during the acceleration pulse, or may be caused by the termination of the acceleration pulse.

The incendiary composition in the incendiary penetrating projectile of the invention is ignited with an inertial ignition system that makes use of the forces produced by an acceleration pulse to initiate combustion within the incendiary penetrating projectile. Ignition can occur at the start of or during the acceleration pulse or be the result of the termination of the acceleration pulse. Preferably, ignition results from contact between a primer and a firing pin. For example, the primer or firing pin may be held in position with a break-wire, such that the force of the acceleration pulse breaks the break-wire, allowing the primer and firing pin to come in contact with a force sufficient to initiate combustion within the incendiary penetrating projectile. The primer and firing pin may also be kept apart by a spring prior to deployment and during storage. The application of a sufficiently high force produced by the acceleration pulse compresses the spring, pressing the primer and firing pin together, and initiating the incendiary composition of the incendiary penetrating projectile.

Preferably, the incendiary penetrating projectile is ignited with a spring-mass system containing a primer and firing pin. As the incendiary penetrating projectile is accelerated forward during deployment, the mass compresses a spring. The compression stores energy from the acceleration pulse. At the end of the acceleration pulse, the energy stored in the compressed spring is released, forcing the mass containing the primer to strike the firing pin with sufficient velocity to ignite the primer. The primer, in turn, ignites the energetic fill of the incendiary penetrating projectile. The forward moving mass ignition system also adds a degree of redundancy to the ignition event. In the event that the incendiary penetrating projectile should not ignite by means of the initial acceleration pulse, the ignition system can be activated by the impulse provided by the penetration of the target.

A second spring may be added which resists motion of the mass in the direction of the firing pin or primer. The spring can be designed such that the primer cannot fire without sufficient input energy. This provides a safety feature which prevents ignition by inadvertent dropping while allowing ignition upon experiencing the threshold acceleration pulse. Preferably, the second spring will prevent ignition of the non-detonating incendiary material when the projectile is dropped from a height of three feet, more preferably, five feet, and, most preferably, ten feet.

A pyrotechnic delay is typically not required to tailor ignition timing. Such delays add to the cost and complexity of the projectile, but may be placed between the primer and energetic fill, where a specific ignition timing is desired. Useful pyrotechnic delays are known in the art.

An incendiary penetrating projectile 10 of the invention is illustrated in a perspective drawing in FIG. 1. As illustrated, the incendiary penetrating projectile comprises a nose 1, having a flat, blunt end 2, and a body or container portion 3. The body 3 is configured to contain the non-detonating incendiary fill of the projectile 10, and includes a tail portion 4. The tail portion 4 of the body 3 may be configured to contain at least a portion of the non-detonating incendiary fill and/or an inertial ignition system. As illustrated, the incendiary penetrating projectile does not include tail fins. Tail fins are not typically required with the incendiary penetrating projectile, when the projectile is properly balanced. The lack of fins facilitates packing of multiple incendiary penetrating projectiles in a mine defeat system. Such fins may be used, where necessary, to balance an incendiary penetrating projectile during flight.

Figure 2:
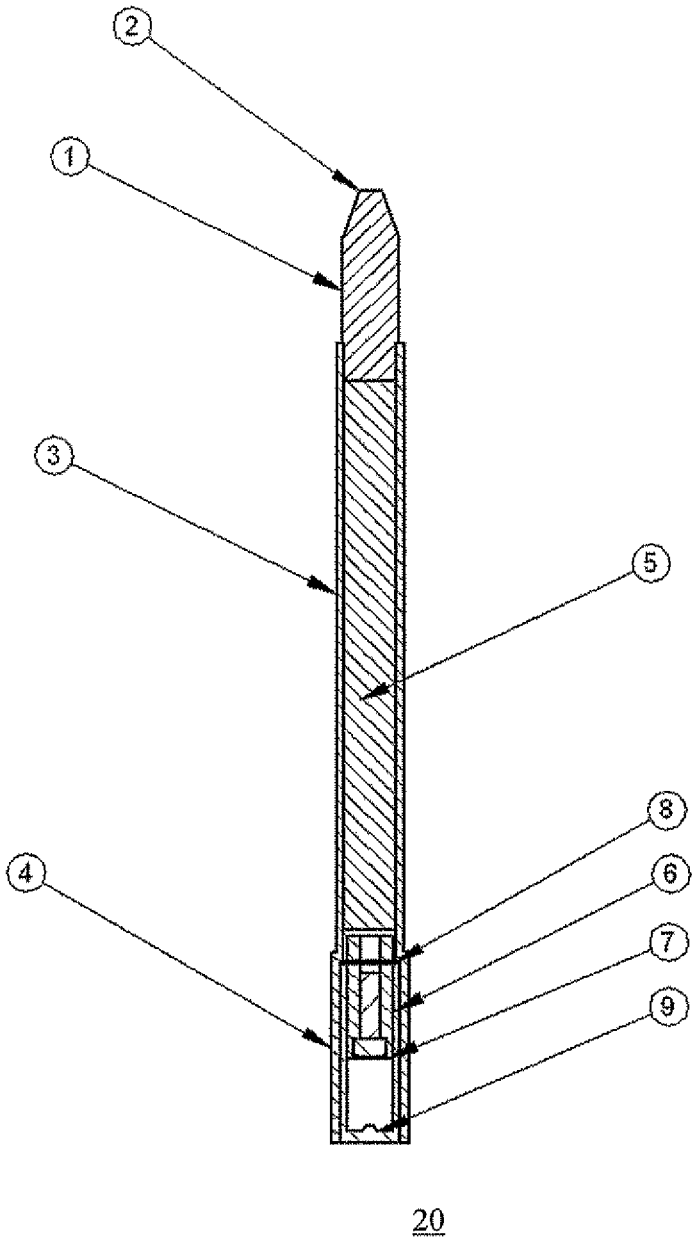
FIG. 2 is a cross-sectional illustration of an incendiary penetrating projectile of the invention, configured for ignition at the start of or during an acceleration pulse.

An incendiary penetrating projectile 20 of the invention, configured for ignition at the start of or during an acceleration pulse is illustrated in FIG. 2 in cross-section. The incendiary penetrating projectile 20 comprises a nose 1, having a flat, blunt end 2, a body or container portion 3, containing a non-detonating incendiary composition 5, and an inertial ignition system 6 in tail portion 4. The inertial ignition system 6 comprises a primer 7, held in position and/or suspended by a break-wire 8, which breaks during an acceleration pulse. The acceleration pulse forces the primer 7 and a firing pin 9 together, initiating combustion of the non-detonating incendiary composition.

Figure 3:
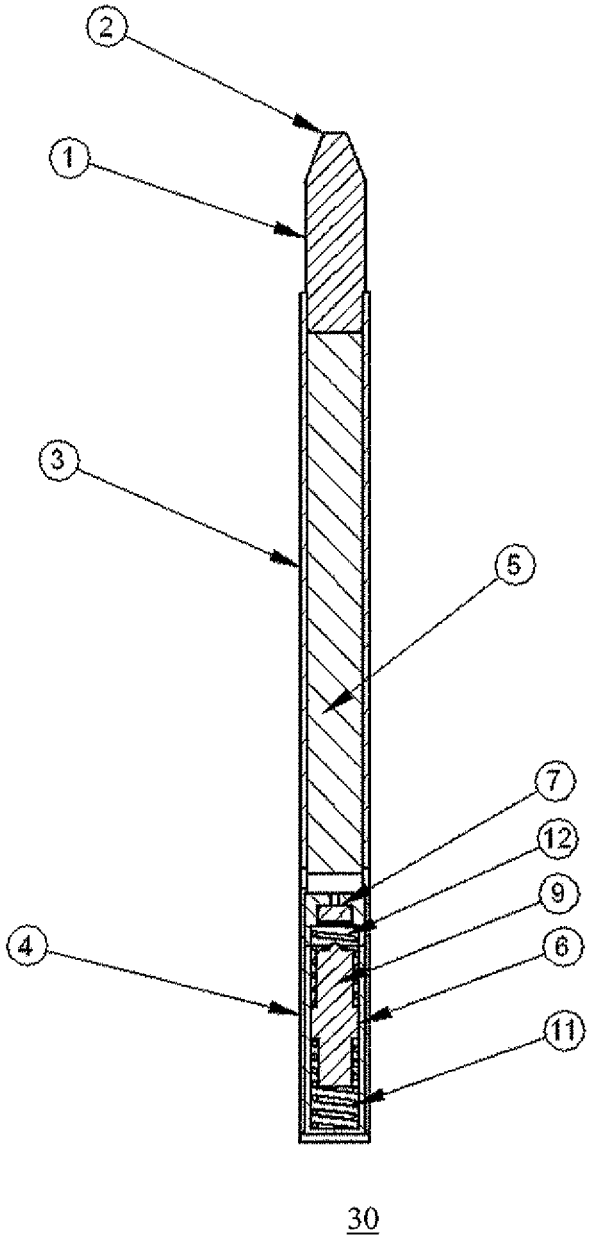
FIG. 3 is a cross-sectional illustration of an incendiary penetrating projectile of the invention in which ignition is triggered by the termination of the acceleration pulse by a spring-mass inertial ignition system in the tail of the incendiary penetrating projectile.

An incendiary penetrating projectile 30 of the invention, configured for an ignition initiated by the termination of an acceleration pulse is illustrated in cross-section in FIG. 3. The incendiary penetrating projectile 30 again comprises a nose 1, having a flat, blunt end 2, a body or container portion 3, containing a non-detonating incendiary composition 5, and an inertial ignition system 6 in tail portion 4. The inertial ignition system 6 comprises a primer 7, a firing pin 9, and a pair of springs 11 and 12. During an acceleration pulse, the mass of the firing pin 9 compresses spring 11. The energy stored by the compression of spring 11 during the acceleration pulse is released at the termination of the acceleration pulse, forcing the firing pin into primer 7, and initiating ignition of the non-detonating incendiary composition 5. As illustrated, the incendiary penetrating projectile 30 also comprise the spring 12, which resists motion of the firing pin 9 in the direction of the primer 7 to prevent ignition unless a predetermined threshold acceleration pulse is achieved. This acts as a safety device in the event the incendiary penetrating projectile experiences an acceleration below the predetermined threshold acceleration pulse that would otherwise initiate ignition of the non-detonating incendiary composition.

Figure 4:
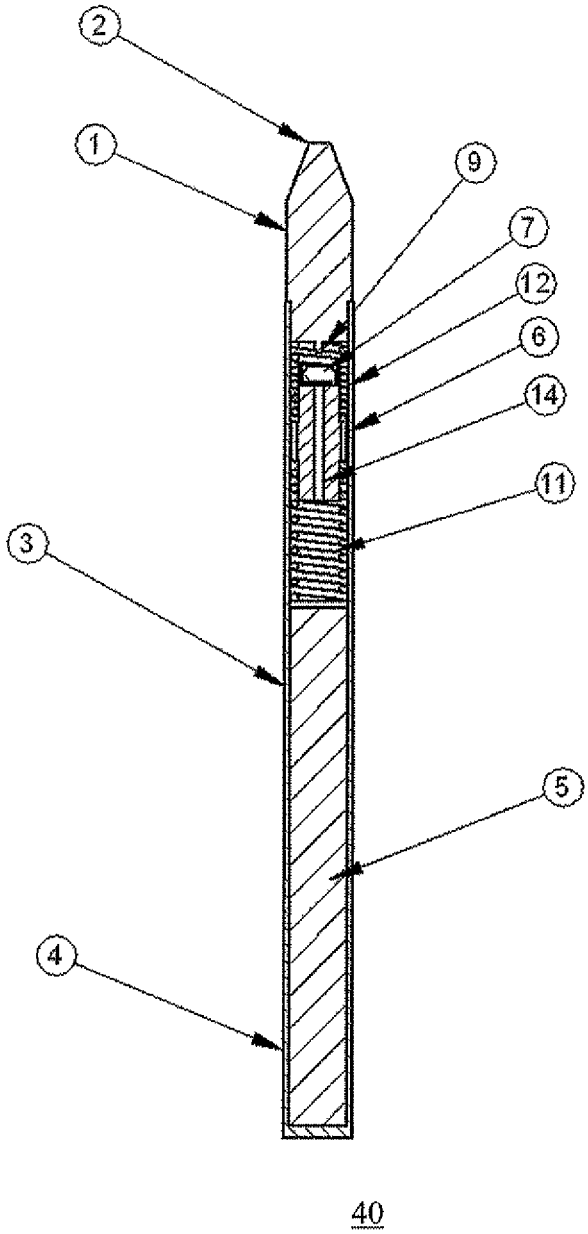
FIG. 4 is a cross-sectional illustration of an incendiary penetrating projectile of the invention in which ignition is triggered by the termination of the acceleration pulse by a spring-mass inertial ignition system in the body of the incendiary penetrating projectile.
Figure 5:
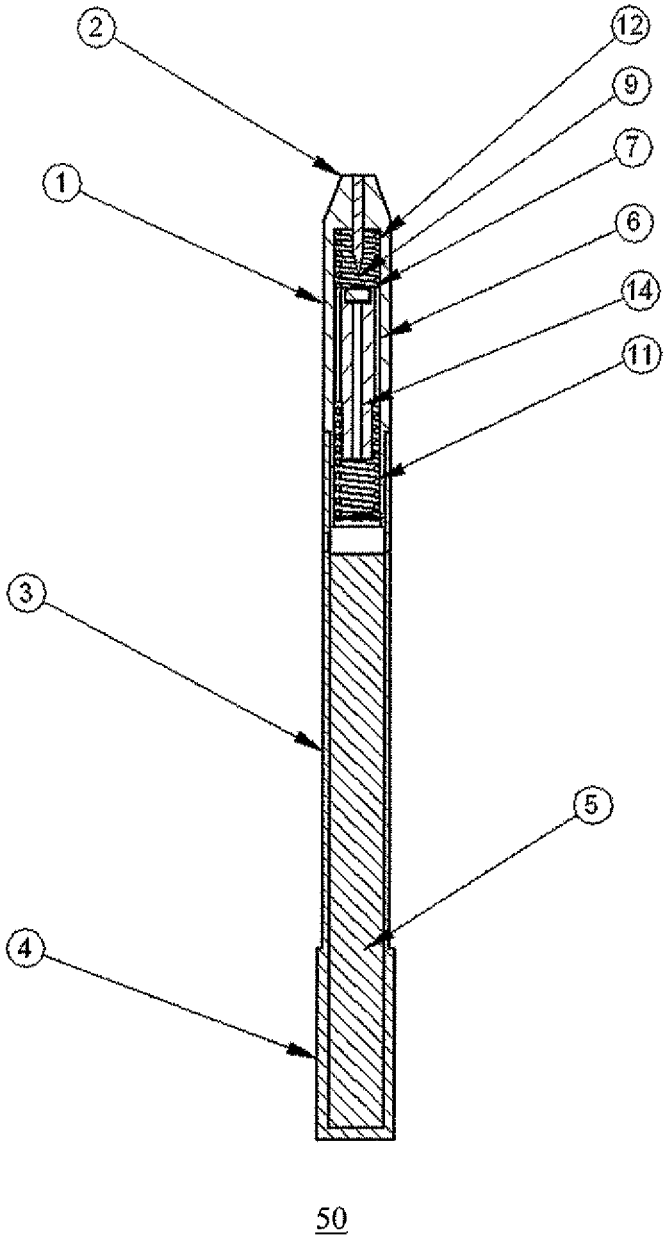
FIG. 5 is a cross-sectional illustration of an incendiary penetrating projectile of the invention in which ignition is triggered by the termination of the acceleration pulse by a spring-mass inertial ignition system in the nose of the incendiary penetrating projectile.

Incendiary penetrating projectiles 40 and 50 of the invention, configured for an ignition initiated by the termination of an acceleration pulse are illustrate in cross-section in FIGS. 4 and 5, respectively. The incendiary penetrating projectiles 40 and 50 again comprise a nose 1, having a flat, blunt end 2, a body or container portion 3, containing a non-detonating incendiary composition 5, and an inertial ignition system 6, where the inertial ignition system 6 comprises a primer 7, a firing pin 9, and a pair of springs 11 and 12. Incendiary penetrating projectiles 40 and 50 differ from the incendiary penetrating projectile illustrated in FIG. 3 in that incendiary penetrating projectiles 40 and 50 are configured with the inertial ignition system 6 in the body 3 and the nose 1, respectively.

In the incendiary penetrating projectiles of FIGS. 4 and 5, during an acceleration pulse, the mass of the primer 7 compresses spring 11. The energy stored by the compression of spring 11 during the acceleration pulse is released at the termination of the acceleration pulse, forcing the primer 7 into the firing pin 9. Hot gases from the initiated primer 7 pass through tube 14, initiating ignition of the non-detonating incendiary composition 5. As illustrated, the incendiary penetrating projectiles 40 and 50 also comprise the spring 12 that acts as a safety device.

Incendiary penetrating projectiles of the invention have several advantages over prior art projectiles. First, incendiary penetrating projectiles provide a high heat flux or hot gas jets from the body of the projectile to ignite the energetic materials of the target device. There are no detonable or hypergolic materials are used in the incendiary projectile.

Second, the incendiary penetrating projectile of the invention is designed to ignite prior to contact with the target device or overburden, and provide a long period of effective heat generation and transfer that eliminates the need for precise ignition timing.

Third, the incendiary penetrating projectiles of the invention are configured, such that the acceleration pulse provides reliable ignition for all projectiles in a payload. In a preferred incendiary penetrating projectile of the invention, the forward spring acts as a safety preventing primer-firing pin interaction unless sufficient energy is present. The rear spring accumulates the energy from the dispense acceleration pulse and releases it when the pulse is over. The incendiary penetrating projectile will still function properly even if ignition is delayed until target impact due to the design of the forward acceleration mass system.

The incendiary penetrating projectile of the invention also overcomes a number of deficiencies of the prior art:

The precision fusing required for a detonating or exploding penetrator or other penetrator that is initiated on impact with a target is eliminated by using an energetic material that releases or transfers energy over a long period of time, and, thus, can be ignited prior to target impact;

The ignition of the energetic fill prior to target impact generates heat or flame during flight, such that combustible liquids or vapors in the immediate target area will be ignited;

A Safe-and-Arm system is not required;

There is no unexploded ordnance (UXO) concern in the target area as the penetrator fill is non-detonable; the penetrator is already functioning upon ground impact and will be completely consumed in a very short period of time The reaction time and subsequent heat flux of the energetic fill is sufficiently long to promote target device ignition;

Reaction of the energetic fill is not subject to quenching by sea water, as the combustion of the non-detonating incendiary material is self-sustaining, and does not require atmospheric oxygen to proceed;

There are no hazardous liquids that cause concern aboard ships or storage facilities; and There are no hazardous components or residual liquid reactants that threaten troops or equipment that follow in the target area.

The primary utility of the incendiary penetrating projectiles of the invention is to render harmless various types of land and seaborne anti-personnel, ship or tank mines and other energetic devices in an area of interest to military forces. The ability of the incendiary penetrating projectile to defeat energetic devices in both land and surf situations gives this invention unique capabilities. In addition to mines, the incendiary penetrating projectile is expected to be effective against ammunition dumps, fuel tanks, light vehicles, aircraft, supply buildings, or any other combustible targets. The incendiary penetrating projectiles of the invention have extended capabilities that provide defeat of targets other than energetic devices. Any target which contains potentially combustible materials or that is sensitive to excessive heat can be defeated by the incendiary penetrating projectiles of the invention.

EXAMPLES

The ability of an incendiary penetrating projectile to ignite trinitrotoluene (TNT) was investigated using penetrator test bodies containing non-detonating incendiary composition fills. One set of test bodies was prepared with a composite propellant, comprising a hydroxy terminated polybutadiene binder system, an ammonium perchlorate oxidizer, an iron oxide burning rate catalyst, a dioctyl adipate plasticizer, and an aluminum powder fuel, as the non-detonating incendiary composition. A second set of test bodies was prepared with a stoichiometric Titanium/Boron Intermetallic (Ti/B) composition as the non-detonating incendiary composition. The composite propellant and Ti/B intermetallic fills were evaluated for their ability to ignite a bare TNT surface and the ability to ignite TNT with a measured quantity of sea water between the penetrator test body and the TNT surface.

Penetrator Fabrication

Penetrator test bodies for composite propellant and Ti/B intermetallic fills were prepared. The test bodies were formed from aluminum tubing, welded closed at one end, and had a wall thickness of 0.0625 inch. The open ends were tapped to accept a closure.

For the composite propellant test bodies, four holes were milled radially every 90° at a point near the open end of the tube. The holes were provided to allow combustion gases and flame to vent radially.

For the Ti/B test bodies, two slots were milled 180° apart along the length of each body, and a single layer of adhesive backed Mylar foil was wrapped around the tube to seal the slots, allowing the Ti/B fill to be loaded. Mylar foil melts rapidly, thereby exposing the pyrotechnic grain on ignition.

Composite propellant was cast within each composite propellant test body up to the bottom of the vent holes. After curing, the propellant was cut back flush with the bottom of the holes, and a booster pellet, comprising ammonium perchlorate, polyvinyl chloride, and organo-phthalates, was placed on the cutback surface, followed by installation of the closure to close the test body.

In the intermetallic test bodies, a pre-blended, hand tamped Ti/B fill was loaded incrementally into each test body, and an ammonium perchlorate, polyvinyl chloride, organo-phthalate booster pellet was placed in contact with the Ti/B fill in a head space configured to accommodate the booster pellet and the closure. Once the assembly was completed, a very thin layer of double-bubble epoxy was spread over the Mylar seams to prevent sea water from leaking into and wetting the Ti/B fill.

In each composite propellant and intermetallic fill test body, a Ni/Cr wire was placed in contact with the booster pellet, such that combustion of the non-detonating incendiary composition could be initiated with an electrical current.

Simulated TNT Mine Fabrication

Tin plated steel cans were used to simulate mine cases. TNT was cast in each of the simulated mines with a center perforation formed in the TNT to simulate the penetration cavities formed from the penetrator impact.

Testing

Testing of the penetrator test bodies was conducted with the simulated TNT mines and video and photographic coverage. For tests simulating immersion in seawater, approximately 10 g of water was placed in the center perforation surrounding the penetrator test body. A single test body was placed in the center perforation of a simulated TNT mine for each test.

Example 1

Composite Propellant without Seawater

A composite test body was placed in the center perforation of a simulated TNT mine with the end of the article having the closure and the four radial holes inserted first. About 0.4 second after the initial ignition of the booster pellet, smoke was observed to appear out of the simulated mine. Over a period of about 1.2 seconds, the smoke was observed to steadily increases in quantity and density, and gas venting could be heard. Almost immediately, flame, having the color of burning TNT, became visible above the top of the simulated mine. About a quarter second later, droplets and/or particles began to be ejected, which may have been non-burning droplets or pieces of TNT broken off from the crystalline fingers along the center hole of the TNT.

For about 4 seconds more, the intensity of the burning increased, as the hissing of gas escaping the penetrator continued. More particles and/or droplets were entrained in the exhaust products and escaped. Most of the particles or droplets were small and burning. Shortly thereafter, the sound of the escaping gas changed to a bubbling sound, indicating that the level of molten TNT had likely risen above the vent holes in the test body.

Over the next 3 seconds or so, vigorous burning occurred with the ejection of flaming droplets of TNT. At that time, a flare up began, and, for about 1 second, the flame grew by a factor of about two, and droplets of burning TNT were thrown higher. The flame then died down to the level before the flare up. For about 4 seconds, the TNT then burned vigorously with burning droplets of TNT continuously thrown into the air.

A large fireball then appeared over the simulated mine, presumably because the closure of the test body detached, ejecting the test body from the simulated mine. For about 0.3 second, molten TNT was ejected from the simulated mine, and, over a period of about 4 seconds, the burning diminished until the TNT was extinguished.

An analysis of the test data demonstrates that ignition occurred almost immediately, as is evident from the distinctive sounds of ignition and continued burning observed in the video. Ignited droplets of molten TNT were evident throughout the burn. Incomplete threads on the closure of the test body are believed to a factor in the ejection of the closure, resulting in the observed explosive event. The rapid venting of the penetrator is believed to be the cause of the expulsion of much of the molten TNT from the simulated mine. The ejected TNT was hot and ready to burn, such that, had the closure of the test body not been ejected, the TNT would most probably have burned to completion.

Example 2

Composite Propellant with Seawater

Almost immediately after the ignition of the booster pellet, the simulated mine was briefly lifted up a fraction of an inch, likely because of a sudden localized pressure that pushed on the bottom of the simulated mine as the gas initially vented from the burning composite propellant. The water column above a bubble of the gas would have momentarily trapped the gas, causing bottom of the simulated mine to bulge, resulting in the movement. The simulated mine then dropped back into its original position when the pressure equalized, returning the bottom to its original shape. It is not clear whether the momentary change in shape damaged the seal of the simulated mine.

For about 1 second, bubbling was heard, as exhaust gas vented through the water in the absence of observable smoke or flame. It is believed that the sea water absorbed any smoke and most of the heat generated by the burning propellant. Shortly thereafter, smoke and/or steam began to appear and vent out of the top of the simulated mine. Black droplets, likely sooty water mixed with molten TNT, began to appear above the simulated mine about 2 seconds after ignition. For about 0.2 second, the droplets were observed to shoot above the simulated mine about an inch and fall back into the simulated mine. At about 0.5 second after ignition, the first flame appeared above the simulated mine. At that point, the booster pellet had burned out. The color of the flame showed that the flame was from burning TNT, as a small area on the top surface of the TNT had ignited and was burning.

For about a second, the flame was seen continuously, and the first black droplets spilled over the side of the simulated mine. At about 3 seconds after ignition, the combustion chemistry changed, demonstrated by the lack of visible flame and the appearance of a gray smoke. It is believed that the burning area of the top of the TNT had been extinguished by the splashing of the black liquid.

For a period of about 5 seconds, the smoke increased in volume and density, and a black viscous liquid could be seen bubbling above the simulated mine, spilling over the side of the simulated mine, and flowing down. The liquid was presumably molten TNT with some water mixed in.

For the next 6 seconds the smoke became thicker and nearly black, and the volume of smoke increased. The black viscous liquid flowed constantly over the side of the simulated mine. It is believed that the black smoke was a combination of the exhaust product of the composite propellant, steam, partially reacted TNT vapor, and vaporized TNT.

Over a little more than 0.1 second, the following were then observed: A sudden jet of gray smoke was observed to shoot up, likely the result of a sudden increase in pressure inside the simulated mine. The inside surface of the TNT then ignited. The smoke jet and part of the smoke plume ignited, beginning from inside the simulated mine, and the flames worked their way out to the fuel rich smoke. The burning smoke jet and plume expanded rapidly, likely causing a wave of high pressure to travel down into the simulated mine in which the molten TNT was burning. The pressure wave would be expected to compress the burning TNT vapors causing the combustion rate to increase dramatically. The TNT is believed to have been burning so rapidly that the combustion gases could not escape sufficiently fast to prevent a choked flow somewhere along the surface of the TNT. The resulting runaway reaction is believed to have pressurize the bottom portion of the simulated mine until the bottom crimp seal failed. As a result, molten, burning TNT was sprayed out of the simulated mine with the combustion products. Most of the molten TNT was either consumed or sprayed out from the top of the simulated mine, and the simulated mine flew upward with the remaining solid TNT, producing a fireball.

Over the next period of a little more than 0.1 second, the following were observed: The simulated mine was no longer visible in the fireball, and there was no evidence of molten TNT having been sprayed downward. Molten droplets of TNT were observed suspended in the fireball. The fireball was observed to start to die down, as the rapid pressure drop cooled the reaction, and the molten TNT droplets in the fireball began to extinguish. At the point when the fireball and molten TNT droplets were nearly extinguished, some of the molten TNT droplets begin to drop back down to the test stand. The last flame was observed, and the remaining TNT droplets reached their maximum altitude. At the completion the chemical reactions, the smoke began to clear, and remaining TNT droplets were observed to be in free fall. At about 15 seconds after ignition, all the TNT droplets were out of the air, and the smoke continued to clear.

Example 3

Ti/B Intermetallic without Seawater

The reaction rate of the Ti/B fill was determined to be approximately 1.0 inches per second (ips). At that rate, the entire column of fill was completely reacted within the first three to four seconds of the test. Thus, any combustion occurring after four seconds in each test of the intermetallic composition should be attributed to the residual reaction heat and the autocatalytic decomposition of the TNT.

Upon ignition of the Ti/B in the penetrator test body, the TNT ignited, and very vigorous combustion was observed immediately after penetrator ignition. Burning incendiary drops of molten TNT were thrown onto the test stand. Very violent burning continued for first 20 seconds after ignition, when the flames died down to a gentle "candle-like" flicker 1 to 2 inches above the simulated mine lip. Approximately 40 seconds later, i.e., about one minute into the test, the intensity of the flames increased, reaching four to six inches above the simulated mine, and burning as if fed with an oxygen stream from below the simulated mine. Combustion continued in this manner for an additional 250 seconds. Total combustion time was 317 seconds, i.e., 5 minutes and 17 seconds. Again, based on the burn rate of the Ti/B intermetallic in the penetrator test body, reaction of the intermetallic fill should have been completed within four seconds of ignition. Therefore, almost all of the 317 second combustion time can be attributed to combustion from the residual reaction heat and the autocatalytic decomposition of the TNT.

Inspection of the test bodies following the test showed that a large amount of ash and the melted penetrator body remained in the simulated mine, but no TNT was observed. A black waxy material was observed splattered on the stand around the simulated mine, which was believed to be sooty solidified TNT.

Example 4

Ti/B Intermetallic with Seawater

Upon ignition of the Ti/B in the penetrator test body, the TNT ignited. As with the simulated mine in Example 3, very vigorous combustion was observed almost immediately. Burning incendiary drops of molten TNT were again thrown onto the test stand, and the seawater boiled rapidly, ejecting a mixture of soot, molten TNT, and water. Very violent combustion continued for the first 30 seconds. The flames then died down to a gentle "candle-like" flicker one to two inches above the simulated mine lip for about approximately 60 seconds, i.e., about 90 seconds into test. The flames then increased in intensity, reaching four to six inches above the simulated mine, as was observed in Example 3. Combustion continued in this manner for an additional 335 seconds. At that time, the TNT in the simulated mine was extinguished. Total combustion time was 395 seconds, i.e., 6 minutes and 35 seconds. Again, based on the burn rate of the Ti/B intermetallic in the penetrator test body, reaction of the intermetallic fill should have been completed within four seconds of ignition. Therefore, almost all of the 395 second combustion time can be attributed to combustion from the residual reaction heat and the autocatalytic decomposition of the TNT.

Further Tests

To resolve any questions as to whether differences in TNT combustion were related to differences in test penetrator test body hardware and ignition locations or heat generating characteristics of the composite propellant and Ti/B fills, additional tests were conducted with standardized penetrator test body hardware and ignition locations to eliminate any bias in the observed TNT combustion. Tests incorporating a drop stand to drop pre-ignited penetrator test bodies into TNT filled targets eliminated any igniter induced ignition of the TNT, and provided a better simulation of the interaction between an actual penetrator and a target. Simulated seawater was also added to TNT filled targets to simulate underwater mines, and determine any effect seawater may have on the ignition of TNT in an underwater mine by an incendiary penetrating projectile of the invention. The test methods and hardware were standardized to eliminate any potential bias influencing performance.

First, tests were performed to determine the time-to-fill ignition and total reaction or burn time of the composite propellant and Ti/B fills, thereby determining when, after ignition, the respective penetrator test bodies should be dropped from the test stand to eliminate any booster pellet interactions. Drop tests in which ignited penetrator test bodies were dropped into TNT filled targets with and without seawater in a penetration cavity were then performed.

Test Body Fabrication

The standardized penetrator test body hardware was fabricated from approximately 5.3 inch long sections of 0.5 inch outer diameter aluminum tubing, having a wall thickness of 0.035 inch. Two aluminum plugs, fixed at either end of the test body with steel pins, sealed the tube once the composite propellant or Ti/B fill was loaded into the test body. The forward plug housed an electric match and booster pellet. The aft plug was threaded to accept a hook to interface with the drop test stand. Two 0.125 inch diameter ports were machined in the forward end of the penetrator test body to exhaust composite propellant combustion gases. Aluminum tape, having a thickness of 0.002 inch, covered the ports to protect the fills from the environment.

Test Target Fabrication

The TNT test targets were thin-wall aluminum screw top canisters filled with about 185 g of TNT. A penetration cavity was formed in the test targets by pouring molten TNT around a mandrel, which was slightly tapered to allow the easy removal of the mandrel once the TNT solidified. The cavity simulated the penetration cavity that forms in a target by a high velocity penetrator impact. The testing was performed both with and without simulated seawater in the TNT test targets. The simulated seawater represented the potential presence of seawater in the penetration cavity of underwater targets. Approximately 38.2 g of seawater, enough to cover the top of the TNT with about a quarter inch of water, was poured into the penetration cavity prior to insertion of the test body into the cavity of the TNT test target.

Simulated Seawater

The simulated seawater was created by mixing various ionic salts in distilled water to achieve ion levels similar to those found in seawater. The simulated seawater typically contained about 96.53 percent by weight distilled water, 2.73 percent by weight NaCl, 0.33 percent by weight $MgCl_2$, 0.21 percent by weight $MgSO_4$, 0.12 percent by weight $CaSO_4$, and 0.08 percent by weight KCl.

Drop Stand

The drop stand was fabricated from ½ inch galvanized pipe. For the first phase time to fill ignition tests, the penetrator test bodies were hung from the cross pipe without the TNT test targets to provide a clear field of view for a high speed video camera. In the second phase tests, the penetrator test bodies were held by a clevis pint in a slotted dispense tube directly above the TNT test target. Once the electric match fired, and the time-to-fill ignition delay was reached, a solenoid pulled the clevis pin, releasing the ignited penetrator test body into the TNT test target.

Example 5

Composite Propellant Static Tests

Two composite propellant test bodies were prepared for testing without a TNT test target. One test body contained 13.07 of the composite propellant, and the other test body contained 13.43 g. The tests results provided an average time from ignition to initial flame observation of about 0.25 second. The transition from booster pellet combustion to a composite propellant combustion could not be distinguished with the high speed video. On average, flame was observed 9.650 seconds after ignition burning through the penetrator test body walls above the two radial vent holes. Once the wall of the penetrator test body was breached, the lower half of the test body was quickly severed, allowing the propellant gases to vent axially from the end of the body. The average time from ignition to propellant burn out was 21.650 seconds.

Example 6

Ti/B Static Tests

The Ti/B used in the initial static tests was pressed into pellets prior to loading into the penetrator test body to facilitate penetrator test body fabrication, and the slots were eliminated in the Ti/B penetrator test bodies to improve their compressive strength. The Ti/B powder was pressed into 0.423 inch diameter, 0.484 inch long pellets having a nominal mass of 2.04 g. Two Ti/B test bodies were prepared and tested. One of the Ti/B test bodies contained 14.33 g of the pressed Ti/B, and the other contained 14.38 g. The test results indicated an average time from ignition to initial flame observation of about 0.03 second. The transition from booster pellet combustion to Ti/B reaction could not be distinguished. The penetrator test body in both tests ruptured slightly above the radial vent holes 0.3 to 0.4 second after ignition, ejecting the Ti/B fill out the end of the tube with a green flame color that is indicative of the combustion of boron with atmospheric oxygen, rather than the desired intermetallic reaction with titanium. The time from ignition to reaction completion, 1.6 seconds, could only be determined in one of the tests, as the penetrator test body in the other test rotated out of the view of the video camera.

To determine whether the reaction time for the Ti/B pellets could be too rapid, the static tests were repeated with hand tamped Ti/B powder in unslotted test bodies of the same design. Again, two test Ti/B bodies were prepared, one contained 11.67 g of tamped Ti/B powder, and the other contained 11.90 g. The results of the two tests provided an average time from ignition to initial flame observation of 0.07 second. The transition from combustion of the booster pellet to Ti/B reaction could not be distinguished on the video. The penetrator test body in each test ruptured slightly above the radial vent holes 0.3 to 0.5 second after ignition, ejecting the Ti/B fill out the end of the tube. Again, green flame from the combustion of boron with atmospheric oxygen was observed. The average time from ignition to reaction completion was 1.63 seconds.

To prevent the repeated rupture of the Ti/B penetrator test bodies, and ensure the penetrator test body stayed together during the Ti/B intermetallic reaction, slotted test bodies were again prepared for Ti/B testing using the standardized hardware. Test bodies were prepared, each with two 0.188 inch wide, 180° opposed slots, along the length of the Ti/B fill. The slots were not covered with aluminum tape so the Ti/B reaction front could be observed on high speed video. Again, two test Ti/B bodies were prepared, one contained 14.17 g of pressed Ti/B pellets, and the other contained 14.47 g. The results of the tests provided an average time from ignition to initial flame observation of 0.13 second. The transition from combustion of the booster pellet to Ti/B reaction again could not be distinguished.

Both tests exhibited a bright white flash approximately 0.4 seconds after ignition, indicative of titanium combustion. The average time from ignition to reaction completion was 0.57 seconds. The Ti/B reaction clinkers continued to emit visible light, i.e., stored energy from the reaction, for an additional 25 seconds. During one test, the aluminum penetrator test body appeared to combust due to the extreme heat generated by the Ti/B reaction. Flames were observed coming from the surface of the aluminum tube after the Ti/B reaction was completed. The post test inspection found a thick white residue, possibly aluminum oxide, covering a solid clinker of reacted Ti/B. Based on the results of the six Ti/B tests, the Ti/B test body design for use in the second phase drop tests was a slotted tube containing pressed Ti/B powder.

Drop Tests

Example 7

Composite Propellant without Seawater

A penetrator test body containing 12.96 g of the composite propellant was prepared, and mounted on the drop stand. The booster pellet was ignited, and the test body was dropped into the TNT test target after ignition of the composite propellant. Immediately after insertion into the test target, a considerable amount of black smoke was observed coming from the test target. Seven seconds after ignition, the penetrator test body rapidly moved upwards, striking the drop stand before settling back into the test target. Approximately 12 seconds after ignition, the penetrator test body was again rapidly thrown upwards, and held against the drop stand until the penetrator test body was ejected from the test target, igniting TNT decomposition gases above the can. A small sooty flickering flame continued to burn for an additional 5 seconds. Total test time was 17 seconds. The post test TNT mass was approximately 139 g, or 76.8 percent of the original TNT mass (181.0 g).

Example 8

Composite Propellant without Seawater

A penetrator test body containing 13.11 g of the composite propellant was prepared, and mounted on the drop stand. The booster pellet was ignited, and the test body was dropped into the TNT test target after ignition of the composite propellant. Immediately after insertion of the penetrator test body into the TNT test target, a considerable amount of black smoke was observed coming from the TNT test target. Approximately 7 seconds after ignition, the penetrator test body was ejected out of the test target onto the table, igniting TNT decomposition gases above the can. A small sooty flickering flame continued to burn for an additional 5 seconds. Total test time was 12 seconds. After ejection, the penetrator test body was propelled off the table by the composite propellant, venting axially out the back of the penetrator test body. The combustion of the composite propellant could be heard off camera for an additional 9 seconds. The post test TNT mass was approximately 161 g, 88.0 percent of the original TNT mass (182.9 g).

Example 9

Composite Propellant without Seawater

A penetrator test body containing 13.32 g of the composite propellant was prepared, and mounted on the drop stand. The booster pellet was ignited, and the test body was dropped into the TNT test target after ignition of the composite propellant. Immediately after insertion into the test target, considerable black smoke was observed coming from the TNT test target. Six seconds after ignition, the penetrator test body rapidly moved upwards striking the drop stand before settling back in the can. Approximately 9 seconds after ignition, the penetrator test body was ejected from the test target, igniting TNT decomposition gases above the can. A small sooty flickering flame continued to burn for an additional 12 seconds. Total test time was 21 seconds. After ejection, the penetrator test body was propelled off the table by the composite propellant gases venting axially out the back of the penetrator test body. The combustion of the composite propellant could be heard off camera for an additional 5 seconds. The post test TNT mass was approximately 160 g, i.e., 83.8 percent of the original TNT mass (190.2 g).

Example 10

Ti/B without Seawater

A penetrator test body containing 12.86 g of tamped Ti/B powder was prepared, and mounted on the drop stand. The booster pellet was ignited, and the test body was dropped into the TNT test target after ignition of the Ti/B. Immediately after insertion of the penetrator test body into the TNT test target, an intense flame about 12 inches high was observed coming from the TNT test target. Approximately 21 seconds after ignition, the intense flame subsided leaving a small sooty flickering flame about 4 inches high. After about 40 seconds, the flame intensified to about 8 to 10 inches high, and continued to burn in a steady state fashion for an additional 230 seconds. The total test time was 271 seconds. The entire mass of TNT (181.9 g) in the test target was consumed.

Example 11

Ti/B without Seawater

A penetrator test body containing 13.22 g of tamped Ti/B powder was prepared, and mounted on the drop stand. The booster pellet was ignited, and the test body was dropped into the TNT test target after ignition of the Ti/B. Immediately after insertion of the penetrator test body into the TNT test target, an intense flame about 12 inches high was observed coming from the TNT test target. A portion of the reacted Ti/B pyrotechnic grain was observed lying on the lid of the test target. Approximately 20 seconds after ignition, the intense flame subsided leaving a small sooty flickering flame about 3 inches high. After about 46 seconds, the flame intensified to about 6 to 8 inches high, and continued to burn with minimal soot in a steady state fashion for an additional 243 seconds. The total test time was 289 seconds. The mass of TNT (182.3 g) in the test target was consumed.

Example 12

Ti/B without Seawater

A penetrator test body containing 12.94 g of tamped Ti/B powder was prepared, and mounted on the drop stand. The booster pellet was ignited, and the test body was dropped into the TNT test target after ignition of the Ti/B. Immediately after insertion of the penetrator test body into the TNT test target, an intense flame about 15 inches high was observed coming from the TNT test target. A portion of the reacted Ti/B pyrotechnic grain was ejected onto the table 2 seconds after ignition. Approximately 21 seconds after ignition, the intense flame subsided leaving a small sooty flickering flame about 3 inches high. After about 43 seconds, the flame intensified to about 6 to 8 inches high, and continued to burn with minimal soot in a steady state fashion for an additional 240 seconds. The total test time was 283 seconds. The entire mass of TNT (186.0 g) in the test target was consumed.

Example 13

Ti/B with Seawater

A penetrator test body containing 12.82 g of tamped Ti/B powder was prepared, and mounted on the drop stand. The booster pellet was ignited, and the test body was dropped into the TNT test target containing simulated seawater after ignition of the Ti/B. Immediately after insertion of the penetrator test body into the TNT test target, an intense flame about 12 inches high was observed coming from the TNT test target. A portion of the reacted Ti/B pyrotechnic grain was ejected onto the table 2 seconds after ignition. Approximately 3 seconds after ignition, the flame went out leaving a thick column of black smoke. The test target continued to smoke for an additional 59 seconds, until the flame relit. The flame intensified to about 6 to 8 inches high, and continued to burn with minimal soot in a steady state fashion for an additional 279 seconds. The total test time was 341 seconds. The entire mass of TNT (189.7 g) in the test target was consumed.

Example 14

Ti/B with Seawater

A penetrator test body containing 12.93 g of tamped Ti/B powder was prepared, and mounted on the drop stand. The booster pellet was ignited, and the test body was dropped into the TNT test target containing simulated seawater after ignition of the Ti/B. Immediately after insertion of the penetrator test body into the TNT test target, an intense flame about 12 inches high was observed coming from the TNT test target. A portion of the reacted Ti/B pyrotechnic grain was ejected onto the table 2 seconds after ignition. Approximately 3 seconds after ignition, the flame went out leaving a thick column of dark grey smoke. The test target continued to smoke for an additional 20 seconds, until the flame relit. A small sooty flickering flame about 3 inches high intensified to about 6 to 8 inches high 36 seconds later, and continued to burn with minimal soot in a steady state fashion for an additional 55 seconds until flame instability occurred. The instability lasted 5 seconds until the flame was finally extinguished. The test target continued to generate a high velocity dark grey smoke without flame for 224 seconds. The total test time was 343 seconds. The entire mass of TNT (184.6 g) in the test target was consumed.

Example 15

Composite Propellant with Seawater

Due to the accuracy problems encountered with dropping the penetrator test bodies from the stand into the TNT test body with simulated seawater, a penetrator test body containing 13.15 of the composite propellant was placed in a TNT test target containing seawater. Immediately after ignition of the composite propellant in the penetrator test body, a considerable amount of black smoke and sooty liquid was observed coming from the TNT test target. Eleven seconds after ignition, the penetrator test body was ejected from the test target, igniting TNT decomposition gases above the can. A small sooty flickering flame continued to burn for an additional 3 seconds. The total test time was 14 seconds. After ejection, the penetrator test body was propelled off the table by the composite propellant gases venting axially out the back of the penetrator test body. The combustion of the composite propellant could be heard off camera for an additional 5 seconds. The post test TNT mass was approximately 165 g, i.e., 85.8 percent, of the original TNT mass (192.3 g).

Example 16

Composite Propellant with Seawater

A penetrator test body containing 13.35 g of composite propellant was prepared, and placed in a TNT test target containing simulated seawater. Immediately after ignition of the composite propellant in the penetrator test body, considerable black smoke was observed coming from the TNT test target. Nine seconds after ignition, the penetrator test body rapidly moved upwards striking the drop stand before settling back in the can. Approximately 15 seconds after ignition, the penetrator test body was propelled away from the test stand, igniting TNT decomposition gases above the can. A small sooty flickering flame continued to burn for an additional 15 seconds. Total test time was 30 seconds. The post test TNT mass was approximately 135 g, i.e., 75.6 percent of the original TNT mass (178.5 g).

Tests with Restrained Penetrator Test Bodies

In test bodies having composite propellant fills, the penetrator test body was typically ejected from the TNT test target within about 7 to 16 seconds after ignition. As the total composite propellant fuel burn time was found to average 21.6 seconds during the static tests, approximately 27.0 percent to 69.5 percent of the propellant mass was not utilized inside the TNT test targets, based on a calculated 0.156 ips burning rate and a propellant density of 0.061 lbs/in$^3$, when a test body was ejected. To evaluate the performance of a composite propellant remaining in the test target for the full duration of the propellant burn, a wire cage was placed around the top of the aluminum canister to retain the penetrator test body.

Example 17

Composite Propellant Cage Test No Seawater

A penetrator test body containing 12.79 g of the composite propellant was prepared, inserted into a test target, and constrained by a wire cage to maintain the test body in the target. Immediately after ignition of the composite propellant in the penetrator test body, considerable dark grey smoke was observed coming from the TNT test target. Eight seconds after ignition, a noise from the test target was heard followed by an increase in smoke generation intensity. Approximately 7 seconds later, an intense flame was observed that quickly subsided to a sooty flickering flame. The flame continued to burn for an additional 8 seconds. The total test time was 22 seconds. The post test TNT mass was approximately 128 g or 69.8 percent of the original TNT mass (183.4 g).

Transparent TNT Test Targets

The mechanism of TNT ignition and combustion appeared to be dependant upon the use of a composite propellant or Ti/B filled penetrator test bodies. A new test target was created using LEXAN® cylinders to observe the ignition and combustion behavior occurring inside the TNT test targets. A wire mesh was used to retain the penetrator test body inside the test target for the duration of the composite propellant burn.

Example 18

Composite Propellant Cage Test No Seawater

A penetrator test body containing 13.30 g of the composite propellant was prepared, inserted into a test target, and constrained by a wire cage to maintain the test body in the target. Immediately after penetrator test body ignition, considerable dark grey smoke was observed coming from the TNT test target. Four seconds after ignition, the flame from the two radial vent holes melted through the TNT casting and impinged on the LEXAN® wall. Approximately 3 seconds later, a noise from the test target was heard followed by an increase in smoke generation and luminosity inside the clear test target. No flame was observed in the head space between the TNT and the lid. The smoke column began to intermittently ignite when a second loud noise was heard and the test target overturned 11 seconds after ignition. The test target was propelled off the table out of the camera view. Total test time was 14 seconds. The post test TNT mass was approximately 120 g or 73.6 percent of the original TNT mass (162.9 g).

Example 19

Ti/B Cage Test No Seawater

The LEXAN® cylinder configuration from the previous example was used to observe the TNT ignition and combustion behavior associated with the Ti/B filled penetrator test bodies. A wire mesh was used to ensure that all of the reacted Ti/B grain was retained in the test target.

A slotted penetrator test body containing 13.09 g of Ti/B was prepared and inserted into the TNT test target. Immediately after penetrator test body ignition, an intense flame about 15 inches high was observed coming from the TNT test target. Five seconds later, boiling TNT could be observed through the solid TNT due to the strong luminescence from the reacted Ti/B grain. Approximately 22 seconds after ignition, the intense flame subsided leaving a small vigorous clean burning flame about 5 inches high. Thirty seconds later, the top of the LEXAN® container began to combust. Flames were observed escaping between the aluminum lid and the LEXAN® wall. However, as with the composite propellant, no flame was observed in the head space between the TNT and the lid at any point during the test. The level of TNT in the test target regressed at a steady rate until all the TNT was consumed 344 seconds after ignition. The LEXAN® container continued to combust until a pile of ash and the two aluminum end plates remained on the test stand. Total test time was 344 seconds. The entire mass of TNT (169.0 g) in the test target was consumed.

Unslotted Ti/B Penetrator Test Bodies

Testing indicated that slots along the penetrator test body were needed to prevent over pressurization and body rupture when Ti/B fills were used in the aluminum penetrator test bodies. However, such slots reduce the structural integrity of the body leading to reduced penetration capability. Different materials were sought for an unslotted penetrator test body that would provide enough strength to prevent rupture during the Ti/B reaction while meeting low weight requirements. 4130 steel tubing having the same outer diameter and wall thickness as the aluminum hardware was procured and machined to match the unslotted design described above. The steel penetrator test body mass (31.61 g) was approximately 3 times the mass of the standard aluminum body (10.34 g).

Example 20

Ti/B Steel Test Body Test No Seawater

An unslotted steel penetrator test body containing 12.17 g of Ti/B was prepared and inserted into a TNT test target. Immediately after penetrator test body ignition, an intense flame about 12 inches high was observed coming from the TNT test target. Approximately 23 seconds after ignition, the intense flame subsided leaving a small sooty flame about 2 inches high. Around 30 seconds, the flame intensified to about 8 to 10 inches high, and continued to burn with minimal soot in a steady state fashion for an additional 66 seconds until flame instability occurred. The instability lasted 9 seconds until the flame was finally extinguished. The test target continued to generate a high velocity dark grey smoke without flame for 200 seconds. Total test time was 337 seconds. The entire mass of TNT (182.7 g) in the test target was consumed.

After testing, the steel penetrator test body was removed from the empty TNT test target and cleaned of all soot for inspection. The body showed no indications of rupture or burn through, although scaling and blistering was observed on the aft end of the body. When in the TNT test target, the nose end of the penetrator test body is submerged in molten TNT, which readily transports the Ti/B reaction heat away from the penetrator test body surface. The aft end is surrounded by the TNT decomposition gases, which are less effective in transporting the Ti/B reaction heat away, leading to higher local penetrator test body temperatures. It is believed that this is the cause of the scaling and blistering on the aft end.

Inspection of the test bodies following the test showed a large amount of ash and the melted penetrator body remaining in the simulated mine, no TNT was observed. A black waxy material was observed splattered on the stand around the simulated mine, which was believed to be sooty solidified TNT.

The results of the simulated TNT mine testing indicate that the Ti/B intermetallic fill successfully ignites and consumes the entire mass of TNT in all tests. The presence of seawater in the TNT perforation does not impede the ignition and combustion of the TNT.

It is believed that the large Ti/B heat transfer rate overwhelms any heat transfer losses, initially combusting the TNT, and allowing a large quantity of TNT to undergo autocatalytic decomposition. Decomposition sustains combustion long after the Ti/B reaction is over. This is supported by the observed combustion behavior. TNT combustion is initially vigorous, corresponding to the rapid generation of heat from the Ti/B reaction. Combustion of the TNT then decreases as the source of reaction energy diminishes. The combustion of the TNT is then self-sustained by the initial TNT autocatalytic decomposition caused by the rapid and significant deposition of heat. Autocatalytic decomposition then begins, increasing combustion intensity, and driving the TNT combustion to completion.

When seawater is placed in the mine perforations, the significant Ti/B heat transfer rapidly vaporizes the seawater allowing combustion of TNT to proceed as previously described.

The test results imply that high penetrator fill heats of reaction and reaction rates are important design considerations. The rate of reaction is a significant factor in performance. The Ti/B intermetallic provided reliable performance with or without seawater, resulting in the complete consumption of the TNT fill in both evaluations.

Where aluminum penetrator bodies are used with the Ti/B intermetallic fill, a method to alleviate internal pressure is preferably incorporated into the dart design, such as the slots described above, to prevent dart body rupture and dispersion of the Ti/B fill. In addition, steel can be used to fabricate unslotted penetrator bodies that can survive the extreme Ti/B reaction temperatures without rupturing.

The aluminum penetrator test bodies also appear to have ruptured from the heat and pressure from the combustion of the composite propellant fill. As a result, the exhaust gas path changed from radial to axial flow, apparently contributing to the ejection of the projectile test bodies from the TNT test targets. It is also believed that the ejection of the composite propellant filled projectile test bodies and the open tops of the TNT test targets allowed liquid TNT formed by the rapid combustion of the composite propellant to be ejected from the test targets, extinguishing the combustion of TNT in the test targets. It would be expected that, upon impact of a propellant filled penetrator into the casing of an actual TNT filled mine, the mine casing would prevent the ejection of the penetrator from the mine, providing combustion of the TNT. In addition, as with the Ti/B penetrators, steel can be used to fabricate penetrator bodies that can survive the heat of combustion of the propellant without rupturing.

What is claimed is:

1. An incendiary projectile, comprising:

a nose portion, to penetrate an intended target;

a container portion, disposed behind and in functional connection with the nose portion, and containing a non-detonating incendiary composition; and an inertial ignition system, comprising a first compressible component that compresses upon acceleration in the direction of the nose portion, and expands to initiate an igniter at about termination of an acceleration pulse, wherein the igniter comprises a primer and a firing pin forced together by expansion of the first compressible component, configured to ignite the non-detonating incendiary composition during or at about termination of the acceleration pulse before penetrating a target.

2. The incendiary projectile according to claim 1, wherein the non-detonating incendiary composition is selected from the group consisting of composite propellants, thermites, thermates, and an intermetallic composition.

3. The incendiary projectile according to claim 1, wherein the non-detonating incendiary composition is selected from the group consisting of Ti/B, Ti/B/Viton A, B/Zr, Al/B, C/Ti, Mg/S, Al/CuO, Zr/CuO, Mg/CuO, Ti/CuO, B/CuO, Al/$Fe_2O_3$, Ti/$Fe_2O_3$, Mg/$Fe_2O_3$, Zr/$Fe_2O_3$, Zr/$MnO_2$, Mg/Al/$KClO_4$, Si/Zr/$Fe_2O_3$/$KClO_4$/$NaSiO_4$, Si/Zr/$Fe_2O_3$/$KClO_4$/Viton A, Ti/B/$BaCrO_4$, $NH_4ClO_4$/Al/hydroxyl-terminated polybutadiene, $NH_4ClO_4$/hydroxyl-terminated polybutadiene, $NH_4NO_3$/epoxy, $NH_4ClO_4$/Al/polysulfide, $NH_4ClO_4$/polysulfide, $NH_4ClO_4$/Al/polyvinyl chloride, $NH_4ClO_4$/ polyvinyl chloride, $NH_4ClO_4$/Al/carboxy-terminated polybutadiene, $NH_4ClO_4$/carboxy-terminated polybutadiene, $NH_4NO_3$/isoprene rubber, and $NH_4NO_3$/cellulose acetate.

4. The incendiary projectile according to claim 3, wherein the non-detonating incendiary composition is a thermite or an intermetallic composition.

5. The incendiary projectile according to claim 3, wherein the non-detonating incendiary composition is an intermetallic Ti/B composition.

6. The incendiary projectile according to claim 1, wherein reaction of the non-detonating incendiary composition produces hot gas.

7. The incendiary projectile according to claim 6, wherein the non-detonating incendiary composition is a composite propellant.

8. The incendiary projectile according to claim 1, wherein reaction of the non-detonating incendiary composition produces heat and substantially no gas.

9. The incendiary projectile according to claim 1, wherein the first compressible component comprises a spring.

10. The incendiary projectile according to claim 1, further comprising a second compressible component that prevents initiation of the igniter when the projectile is dropped onto the nose portion from a height of about 3 meters or less.

11. The incendiary projectile according to claim 10, wherein the second compressible component comprises a spring.

12. The incendiary projectile according to claim 1, wherein the inertial ignition system is configured to ignite the non-detonating incendiary composition at about termination of the acceleration pulse.

13. The incendiary projectile according to claim 12, wherein the inertial ignition system is configured in the tail portion of the projectile.

14. The incendiary projectile according to claim 12, wherein the inertial ignition system is configured in the container portion of the projectile.

15. The incendiary projectile according to claim 12, wherein the inertial ignition system is configured in the nose portion of the projectile.

16. The incendiary projectile according to claim 1, wherein the duration of the acceleration pulse is from about 20 to about 80 ms.

17. The incendiary projectile according to claim 1, further comprising a tail portion.

18. The incendiary projectile according to claim 17, wherein the tail portion is configured to contain a portion of the non-detonating incendiary composition and/or the inertial ignition system.

19. A system for the destruction and/or disablement of targets containing explosive or energetic fills, the system comprising:

a plurality of incendiary projectiles, as recited in claim 1;

a shell from which the incendiary projectiles are dispensed;

a propulsion device for providing an acceleration pulse to the shell and the projectiles therein; and a release mechanism for releasing and dispersing the projectiles.

20. The incendiary projectile according to claim 19, wherein the target is a mine.

* * * * *